US007156067B1

(12) United States Patent
Gottschalk

(10) Patent No.: US 7,156,067 B1
(45) Date of Patent: Jan. 2, 2007

(54) APPARATUS AND METHOD FOR CONDUCTING OIL WITHIN A MOTORCYCLE FRAME SPACE

(76) Inventor: Kent J. Gottschalk, 282 Maple Dunes Ct., Wichita, KS (US) 67235

( * ) Notice: Subject to any disclaimer, the term of this patent is extended or adjusted under 35 U.S.C. 154(b) by 0 days.

(21) Appl. No.: 11/105,919

(22) Filed: Apr. 14, 2005

(51) Int. Cl.
*B67C 11/00* (2006.01)

(52) U.S. Cl. ..... 123/198 DB; 123/196 R

(58) Field of Classification Search ..... 123/196 R, 123/196 A, 198 DA
See application file for complete search history.

(56) References Cited

U.S. PATENT DOCUMENTS

| | | | | |
|---|---|---|---|---|
| 4,266,452 | A | 5/1981 | Crist | |
| 4,867,017 | A | 9/1989 | Holman | |
| 5,065,648 | A | 11/1991 | Hoefbaum, Jr. | |
| 5,271,299 | A | 12/1993 | Wadsworth | |
| 5,454,960 | A * | 10/1995 | Newsom | 210/805 |
| 5,469,935 | A | 11/1995 | Hewuse | |
| 5,655,624 | A | 8/1997 | Kelly, Jr. | |
| 5,857,503 | A * | 1/1999 | Vreeken | 141/332 |
| 5,975,156 | A * | 11/1999 | Senour | 141/98 |
| 6,056,874 | A * | 5/2000 | Goodman | 210/248 |
| 6,227,078 | B1 | 5/2001 | Lemmo, Jr. | |
| 6,401,574 | B1 | 6/2002 | Myers | |
| 6,401,770 | B1 | 6/2002 | Eimer | |
| 6,423,222 | B1 | 7/2002 | Shiveley et al. | |
| 6,769,516 | B1 | 8/2004 | Carlson | |
| 2002/0108675 | A1 | 8/2002 | Yribarren et al. | |
| 2002/0113002 | A1 | 8/2002 | Shively et al. | |
| 2004/0055827 | A1 | 3/2004 | Carlson | |

* cited by examiner

*Primary Examiner*—Stephen K. Cronin
*Assistant Examiner*—Jason Benton
(74) *Attorney, Agent, or Firm*—Kenneth H. Jack; Davis & Jack, L.L.C.

(57) ABSTRACT

An apparatus and method for laterally conducting oil within a motorcycle frame space, the motorcycle frame space being longitudinally bounded by an engine having a protrusion, the space being oppositely laterally bounded by an oil filter manifold having a removably attached oil filter, the apparatus including a bushing fitted for oil filter passage and for nesting receipt of an annular bearing surface of the manifold; the apparatus further including an oil sluice and a wholly formed joint interconnecting the sluice and the bushing, the joint orienting the oil sluice so that the oil catch and oil drain ends of the oil sluice may respectively underlie the oil filter and extend laterally from the frame space; the method including steps of extending the bushing into the motorcycle frame space and over the oil filter for nestingly receiving the manifold's bearing surface within the bushing; removing the oil filter; and catching and laterally conducting the oil along the oil sluice for collection outside the frame space.

6 Claims, 5 Drawing Sheets

APPARATUS AND METHOD FOR CONDUCTING OIL WITHIN A MOTORCYCLE FRAME SPACE

FIELD OF THE INVENTION

This invention relates to the motorcycle maintenance arts. More particularly, this invention relates to apparatus, assemblies, methods and procedures which are adapted and directed to achieving clean and efficient motorcycle oil changes.

BACKGROUND OF THE INVENTION

Motorcycles having air cooled engines typically incorporate an oil flow system for lubricating internal engine parts and for additional cooling of the engine. Such systems commonly comprise an oil filled crank case, an exterior oil reservoir, an oil pump, an oil filter manifold and filter assembly, an oil heat radiator, and a network of oil lines or conduits interconnecting the above elements in a closed loop series. Operation of a motorcycle engine which is equipped with such an oil flow system commonly tends to introduce into the oil contaminants and by-products of combustion, and tends to slowly diminish the oil's lubricating capability. Accordingly, the oil in such system must be periodically purged and replaced.

To facilitate purging and changing of oil within an oil flow system such as is described above, such motorcycles typically provide an oil outlet port located at a low point in the system. Such low drainage point is typically located below the motorcycle engine's crank case, and such port is typically valved by a removable helically threaded plug. At the commencement of performance of an oil change upon such exemplary motorcycle, an oil catching basin may be conveniently placed beneath such plug, and such plug may then be removed, allowing a majority of the oil in the system to emit downwardly into the basin without spillage upon other motorcycle surfaces.

An integral aspect of such motorcycle oil purging and changing procedure, as described above, typically includes removal and interchange of the system's oil filter. A motorcycle, such as described above, typically mounts the oil filter manifold and its supported oil filter within a laterally opening frame space which is closely longitudinally bounded by the motorcycle's engine and front frame struts. Such frame space is also typically oppositely laterally bounded by the oil filter manifold itself, and is closely vertically bounded by underlying engine and frame components. Upon threaded removal of such oil filter, residual oil contained within the oil filter and contained within the manifold typically undesirably spills downwardly therefrom onto motorcycle structures which surround and underlie the oil filter and manifold. Such residual spilled oil is difficult to clean within the frame space crowded with structures as described above.

The instant inventive apparatus and method solves or ameliorates the motorcycle oil changing problems discussed above by providing unique structural assemblies and method steps for laterally conducting such residual and otherwise spilled oil out of the frame space for convenient collection and disposal.

BRIEF SUMMARY OF THE INVENTION

A first structural component of the apparatus of the instant inventive apparatus and method comprises a bushing. Preferably, the bushing is configured as an annular sleeve or ring having an annular inner slide surface for nesting receipt of and for rotatable sliding motion about a peripheral bearing surface of a motorcycle's oil filter manifold. For purposes of structural integrity of the bushing element, it is preferred that the bushing form a 360° circle. In circumstances where an oil filter manifold upon which the bushing is to be mounted lacks a continuous 360° annular outer peripheral surface, the bushing element may suitably alternately assume a "C" configuration, the gap in such otherwise circular bushing being positioned for accommodating obstructions which interrupt the manifold's annular periphery.

Motorcycle oil filters and oil filter manifolds commonly have polished chrome or painted outer coverings. Accordingly, it is preferred that the bushing element of the instant inventive apparatus comprise plastic for prevention of gouging or scratching of such chrome or painted surfaces which may occur upon contact of the bushing with such surfaces. The bushing element preferably has a lateral face, the lateral face having a lower end, and the lower end of the lateral face preferably having an upper end whose function will be described below.

A further structural component of the apparatus of the instant invention comprises a laterally extending oil sluice which necessarily opens concavely upward. The laterally extending oil sluice preferably includes a pair of walls, a first wall among the pair extending longitudinally and upwardly, and a second wall among the pair extending oppositely longitudinally and upwardly. Preferably, both of such walls are arcuately curved, closely matching the curvature of the bushing. The oil sluice necessarily includes a lateral oil drain end and an oppositely lateral oil catch end.

A further structural component of the apparatus of the instant invention comprises means for attaching or interconnecting the oppositely lateral oil catch end of the oil sluice to the bushing. Where the bushing is composed of the preferred plastic material, the attaching means preferably comprises a wholly formed joint arising out of a plastic injection molding fabrication process. Suitably, the attaching means may alternately comprise an adhesively bonded joint or a welded joint. Other connecting or fastening means such as rivets, screws, and helically threaded nut and bolt combinations are also considered to fall within the scope of the invention.

In performance of the method of the instant invention, a majority of oil from the oil flow system a motorcycle, such as is described above, may be drained by a technician into a catch basin situated beneath the motorcycle's crank case oil drain port. Thereafter, the technician preferably preliminarily loosens the motorcycle's oil filter, utilizing an oil filter wrench. The loosening step preferably is insufficient to allow residual oil to begin to purge or downwardly drip from the oil filter manifold and the oil filter, while being sufficient to allow subsequent manual and wrenchless removal of the oil filter. Thereafter, according to method of the instant invention, the bushing and sluice assembly, configured and provided as described above, is oppositely laterally extended into the motorcycle frame space described above, and toward the oil filter and oil filter manifold. Upon further oppositely lateral extension of such assembly, the bushing receives and concentrically passes over the oil filter. Upon further oppositely lateral extension of such assembly, the bushing nestingly receives the oil filter manifold's annular outer surface. Such nesting receipt effectively mounts the assembly upon the manifold, and orients the oil catch end of the sluice beneath the oppositely lateral end of the oil filter while laterally extending the sluice from the frame space.

Thereafter, the technician preferably places an upwardly opening oil collecting basin beneath the oil drain end of the sluice.

Thereafter, the technician preferably manually removes the oil filter, allowing residual oil to purge downwardly onto the oil catch end of the sluice to be thereby conducted laterally out of the frame space, and thence falling downwardly into said basin. Thereafter, the apparatus may be removed, and a new oil filter may be screwed into place upon the oil filter manifold.

By following the above described method steps, the oil filter is advantageously interchanged without undesirable spillage of residual oil upon motorcycle frame and engine component surfaces.

The above described mount of the bushing element of the apparatus upon the oil filter manifold's annular surface may, on occasion, substantially horizontally orient and extend the sluice. As a result of such orientation, residual oil spilling from the manifold and from the oil filter onto the catch end of the sluice may undesirably flow oppositely laterally toward the juncture of the bushing and the manifold, resulting in undesirable oil spillage upon motorcycle engine component and frame surfaces. In order to resist such backflow and spillage, the attaching means which interconnects the bushing and sluice preferably further orients the sluice with respect to the bushing so that the above described upper end of the lower end of the lateral face of the bushing remains laterally exposed, such upper end advantageously forming a coffered step which functions as an oil backflow dam.

The above described method step of oppositely laterally extending the bushing into the oil frame space may be undesirably mechanically blocked by oppositely longitudinally extending engine component protrusions such as the engine's oil pressure sending unit or gear shift linkage. In order to avoid such protrusions upon performing the above described oppositely laterally extending step, the bushing may be rotated, skewing the sluice away from its desired final horizontal orientation. Thereafter, the bushing may be guided around such protrusions while the technician performs such apparatus extension step. Thereafter, upon secure nesting receipt by the bushing of the oil filter manifold's annular bearing surface, the sluice is desirably counter-rotated to return to horizontal orientation. However, such exemplary protrusions tend to undesirably block such horizontal re-orientation. In order to overcome such mechanical blockage and in order to allow horizontal re-orientation of the sluice, the sluice's preferred longitudinally and upwardly extending wall may advantageously be provided with a fitted sluice leveling notch which, upon such horizontal re-orienting counter-rotation, nestingly receives such engine protrusions.

Accordingly, objects of the instant inventive apparatus and method include the provision of an apparatus or assembly comprising structural elements and features as described above, and including method and use steps directed to such apparatus or assembly as describe above.

Other and further objects, benefits, and advantages of the instant inventive apparatus and method appear below in the Detailed Description of a Preferred Embodiment, and further appear in the appended drawings.

DETAILED DESCRIPTION OF A PREFERRED EMBODIMENT

Figure 1:
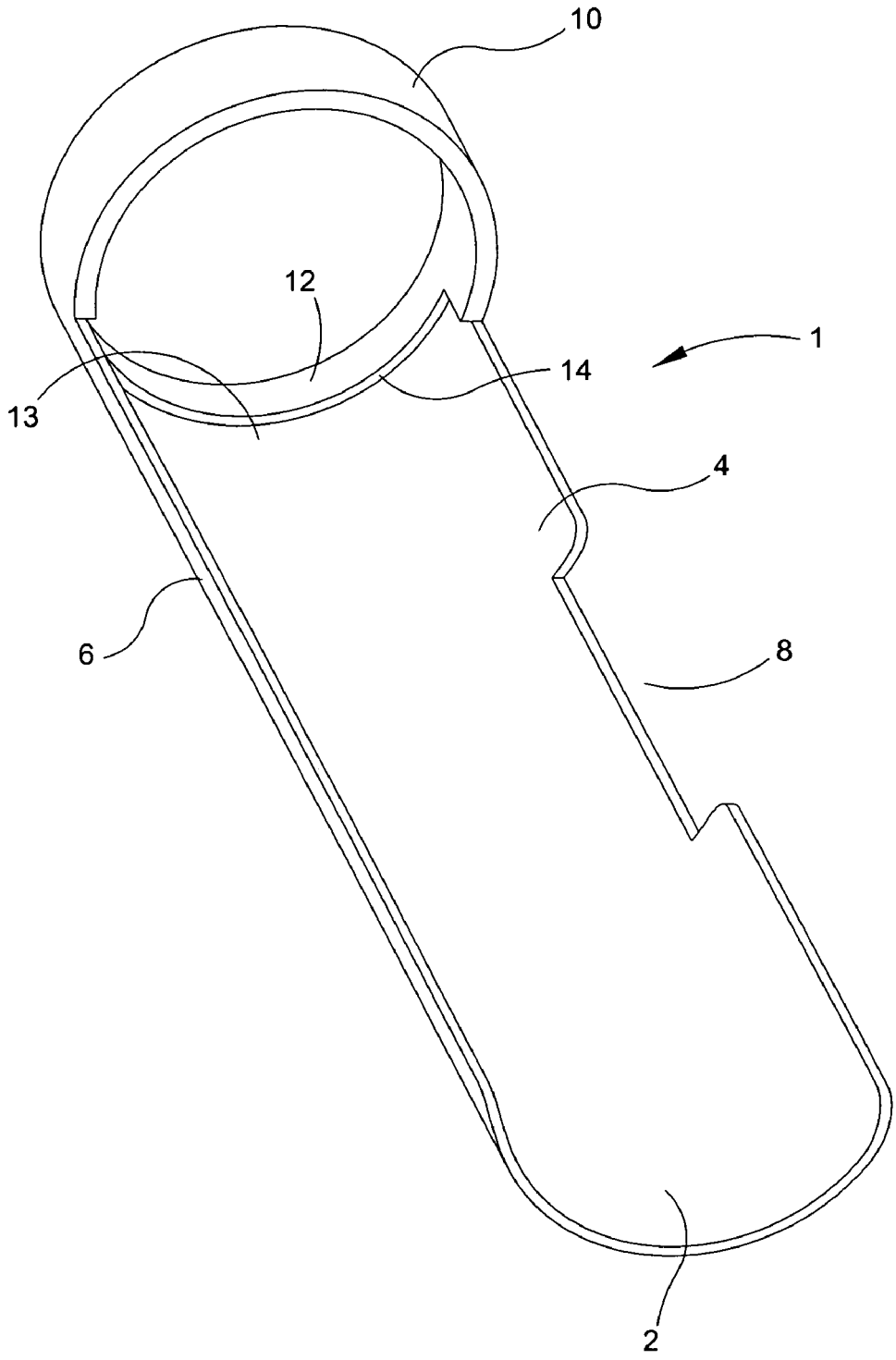
FIG. 1 is an isometric view of the apparatus component of the instant invention.

Referring now to the drawings, and in particular to FIG. 1, the apparatus of the instant inventive apparatus and method is referred to generally by Reference Arrow 1. The apparatus 1 comprises a laterally extending sluice 2 and a bushing 10, preferably having a circular inner slide surface 12. The sluice 2 has an oil catch end 13 fixedly attached to the bushing 10, and has a laterally extending oil drain end opposite the oil catch end 13. The oil catch end 13 preferably extends oppositely laterally into the bushing 10 for purposes further described below.

Referring further to FIG. 1, the preferred oppositely laterally set juncture or connection between the oil catch end of the sluice 2 and the lateral face of bushing 10 preferably comprises a wholly formed joint, such joint preferably being formed in a plastic injection molding process.

Referring further to FIG. 1, the sluice 2 preferably comprises a longitudinally and upwardly extending wall 4 and an oppositely longitudinally and upwardly extending wall 6. The longitudinally and upwardly extending wall 4 preferably is provided an oil sluice leveling notch 8 whose function is further discussed below.

Referring further to FIG. 1, the bushing 10 and the sluice 2 are preferably interconnected and oriented with respect to each other so that the upper end of the lower end of the lateral face of the bushing 10 forms a coffered step 14 which advantageously functions as an oil backflow dam.

Figure 2:
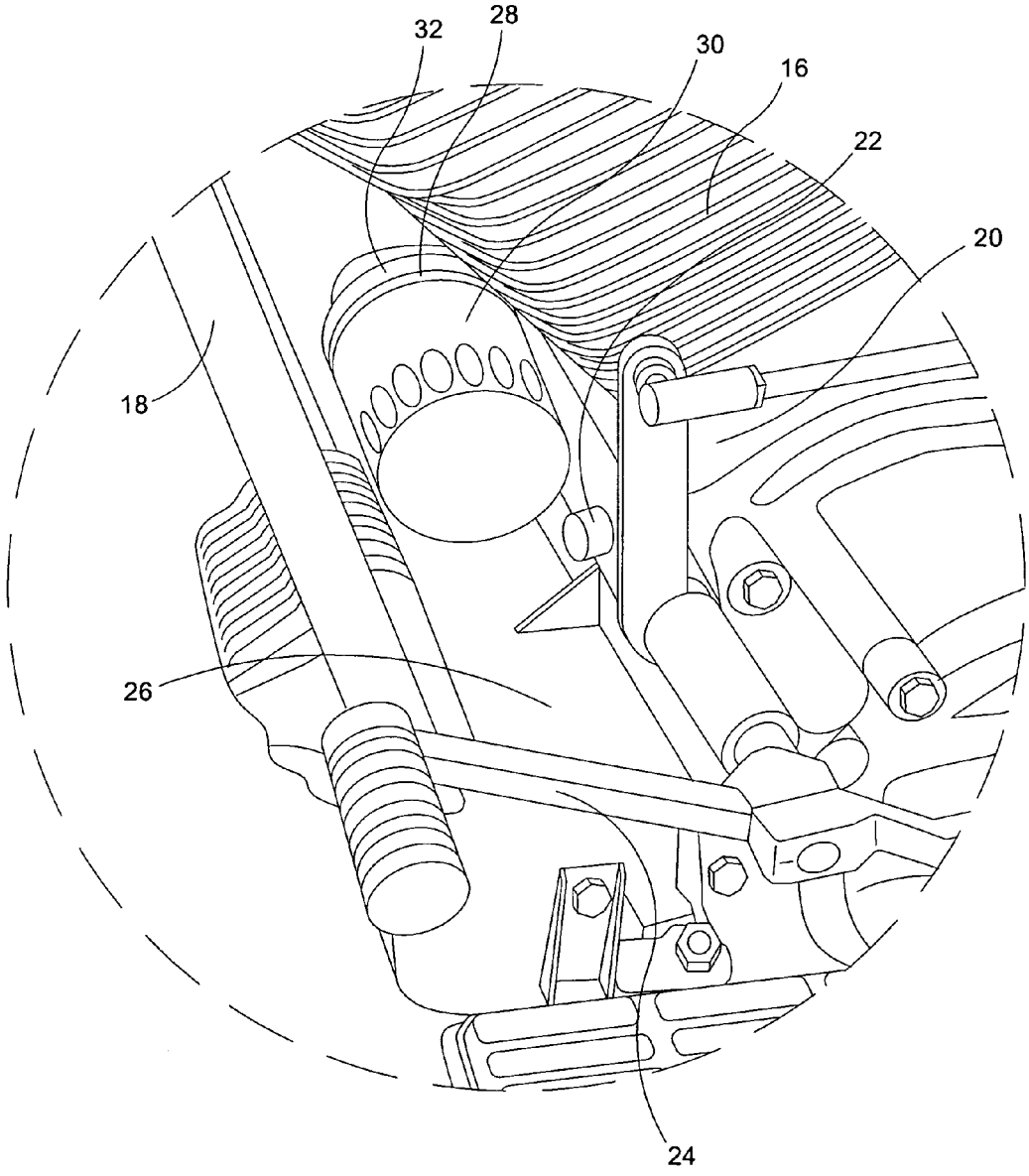
FIG. 2 depicts an isometric view of an exemplary motorcycle frame space wherein the apparatus of FIG. 1 may be utilized in performing the method of the instant invention.

Referring to FIG. 2, a partial view of an exemplary motorcycle is depicted, such motorcycle having a longitudinally positioned air cooled engine 16, having oppositely longitudinally positioned forward frame struts or down tubes 18, and having an oppositely laterally positioned oil filter manifold 32. Such engine 16, struts 18, and manifold 32 structures define and form boundaries of a laterally opening motorcycle frame space 26. An oil pressure sending unit 22 and a gear shift linkage 20 constitute exemplary mechanical protrusions which extend oppositely longitudinally into such laterally opening motorcycle frame space 26.

Figure 5:
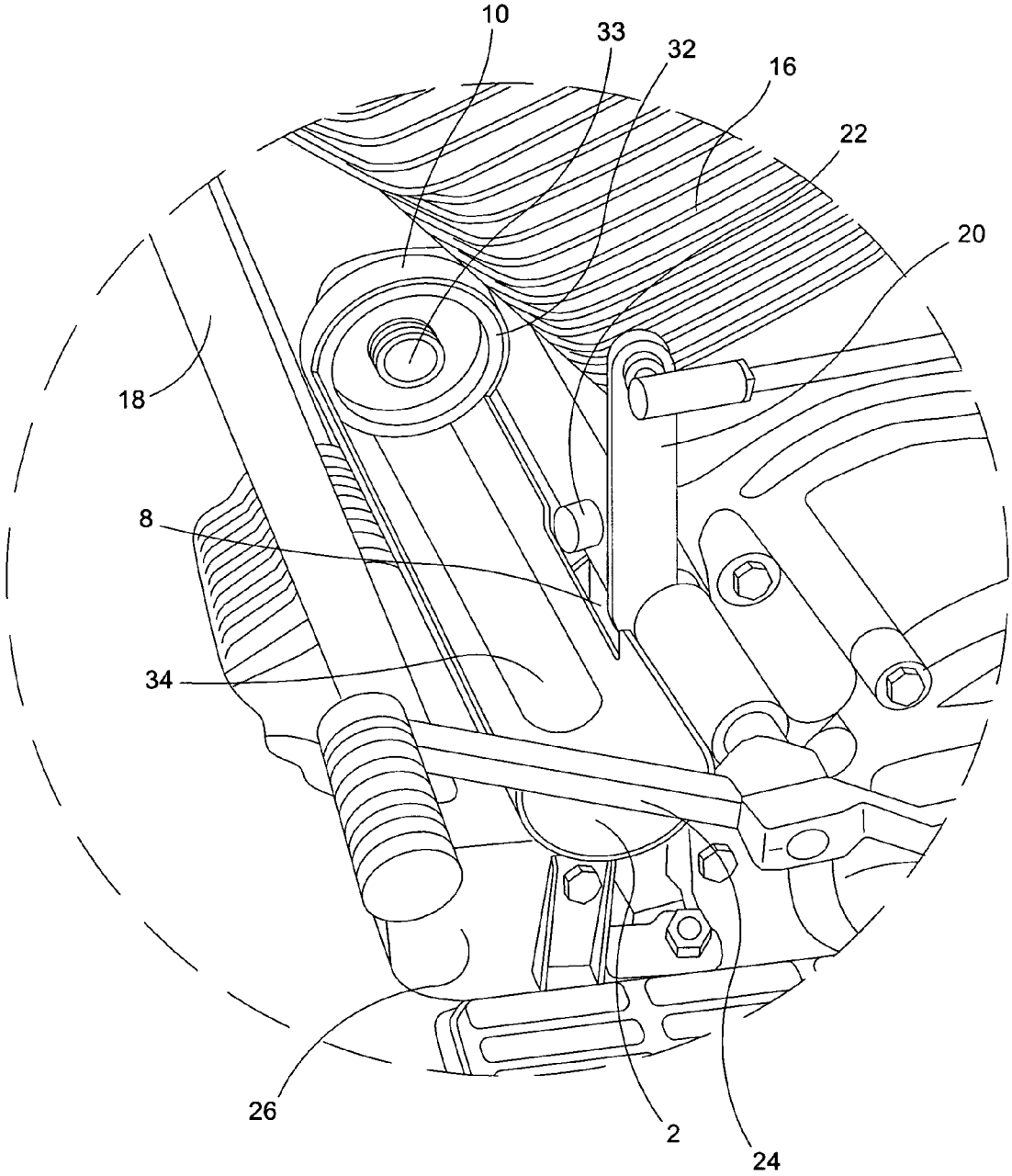
FIG. 5 redepicts FIG. 4, the view depicting a step of oil filter removal.

Referring simultaneously to FIGS. 2 and 5, an oil filter 30 is threadedly mounted upon a helically threaded nipple 33 of oil filter manifold 32, such threaded attachment compressing the base or oppositely lateral end 28 of the oil filter 30 against the circular lateral sealing surface of the oil filter manifold 32.

Figure 3:
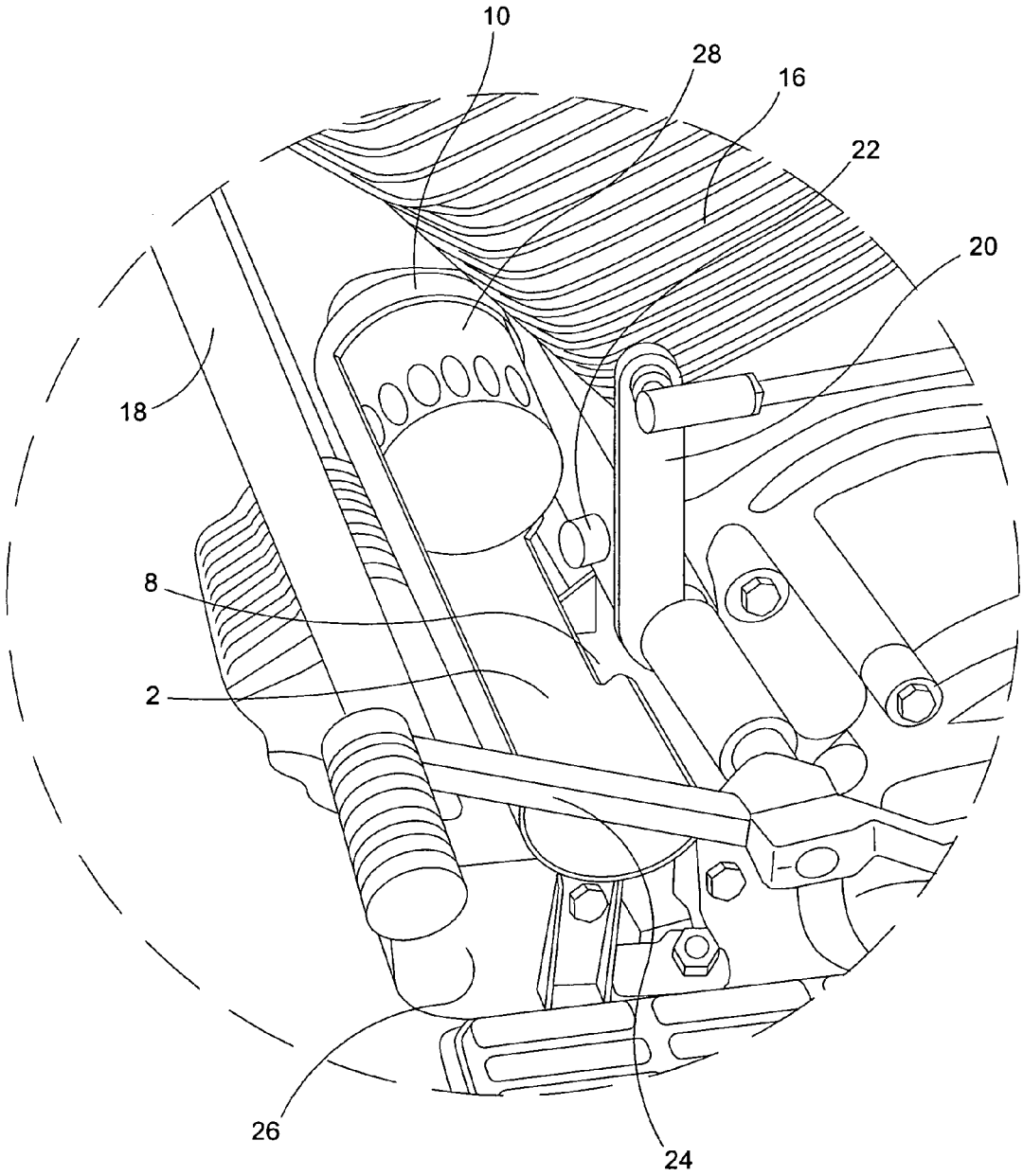
FIG. 3 redepicts FIG. 2, the view of FIG. 3 further depicting a step of installation of the apparatus of FIG. 1.

Referring to FIG. 2, in performance of an oil change procedure, the oil filter 30 is typically threadedly removed and replaced with a new oil filter. Such replacement process typically allows residual oil to spill from the oil filter manifold 32 and from the oil filter 30, undesirably fouling and soiling underlying engine and frame parts. In order to ameliorate such problem in accordance with the method of the instant invention, a technician preliminarily utilizes an oil filter wrench (not depicted) to loosen oil filter 30. Thereafter, referring further simultaneously to FIGS. 1 and 3, the apparatus 1 is oppositely laterally extended into the frame space 26, situating the apparatus 1 between gear shift pedal arm 24 and the oil filter manifold 32, as depicted in FIG. 3. In the position depicted in FIG. 3, bushing 10 has been concentrically extended over filter 30 to nestingly receive and mount upon the annular bearing surface of the oil filter manifold 32. As depicted in FIG. 3, during such extension step, the apparatus 1 is advantageously rotated clockwise away from the horizontal so that sluice wall 4 may mechanically clear the exemplary oil pressure sending unit 22 and gear shift linkage 20 protrusions.

Figure 4:
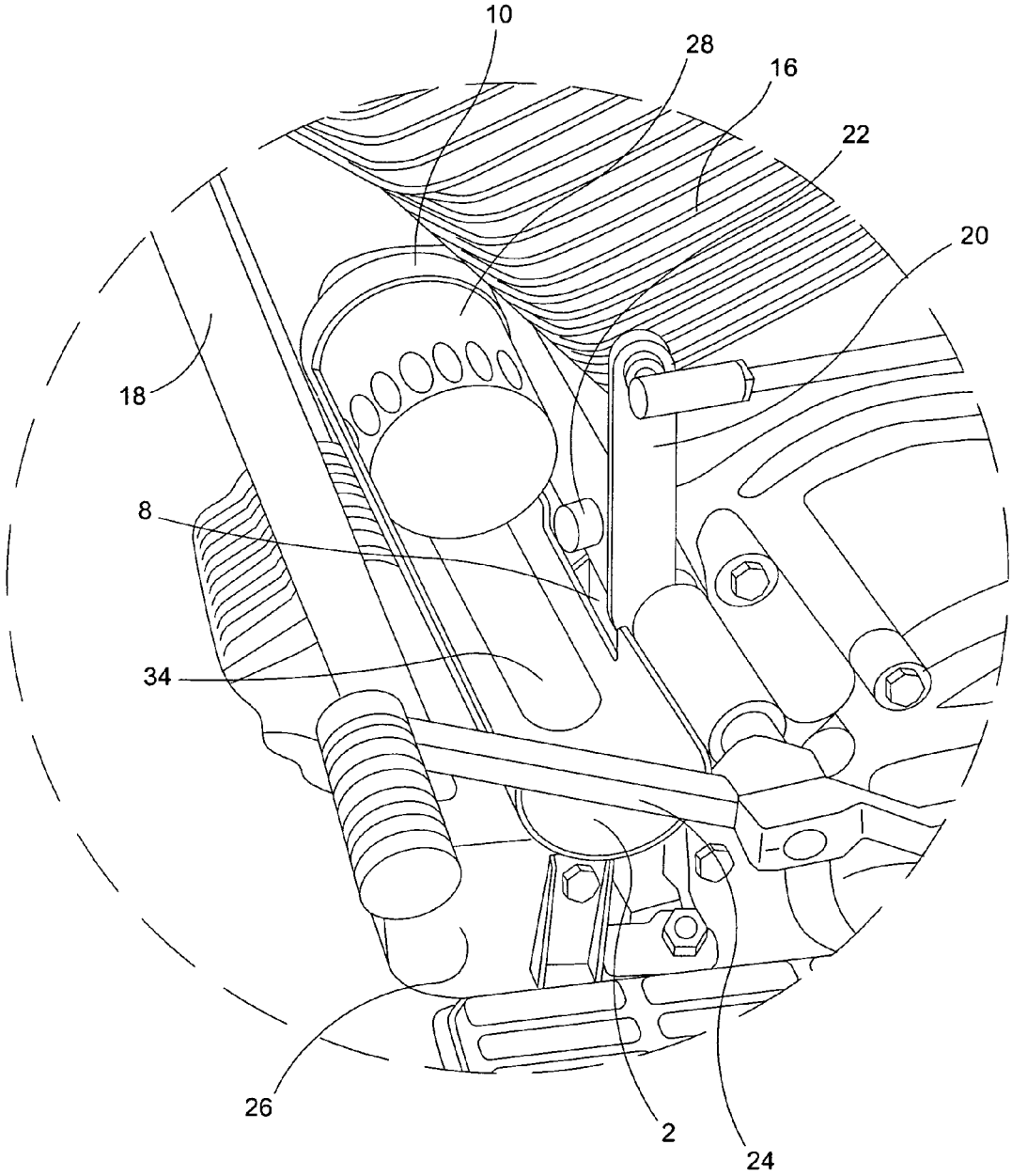
FIG. 4 redepicts FIG. 3, the view of FIG. 4 depicting a steps of re-orienting the apparatus element, and drainage of oil.

Referring simultaneously to FIGS. 1, 3, and 4, as a next successive method step of the instant inventive method, the technician may manually counter-rotate both the sluice 2 and the bushing 10 in a counter-clockwise direction about the annular bearing surface of the manifold 32, such rotation causing the sluice leveling notch 8 to nestingly receive the oil pressure sending unit 22 and the lower end of the gear shift linkage 20. Thereafter, referring further simultaneously to FIG. 5, such technician may fully remove oil filter 30, allowing residual oil 34 to flow from the opened manifold 32 and from the oil filter 30 onto the oil catch end 13 of the sluice 2. The preferred oppositely lateral set of oil catch end 13 extending into bushing 10 allows the extreme oppositely lateral end of the sluice 2 to underlie and to extend oppositely laterally beyond the lateral face of manifold 32 and the base 28 of oil filter 30, such oppositely lateral extension assuring that residual oil 34 initially downwardly flows onto a point upon the sluice 2 which is laterally removed from the back flow dam 14. Accordingly, the oppositely lateral set of the oil catch end 13 of the sluice 2 and the dam 14 work in combination for effective oil spill prevention. After the oil 34 flows to a point upon sluice 2 which is laterally removed from claim 14, the oil 34 is immediately further laterally conducted along the sluice 2 towards its laterally extending oil drain end. An oil catching basin (not depicted) may be conveniently placed beneath the oil drain end of the sluice 2 for collecting the oil 34. Thereafter, referring simultaneously to all figures, the apparatus 1 may be laterally removed and a new oil filter may be reinstalled upon the oil filter manifold 32.

While the principles of the invention have been made clear in the above illustrative embodiment, those skilled in the art may make modifications in the structure, arrangement, portions, components, and method steps of the invention without departing from those principles. Accordingly, it is intended that the description and drawings be interpreted as illustrative and not in the limiting sense, and that the invention be given a scope commensurate with the appended claims.

I claim:

1. An apparatus for laterally conducting oil within a motorcycle frame space, the motorcycle frame space being longitudinally bounded by a motorcycle engine, the motorcycle engine having at least a first protrusion extending oppositely longitudinally into the motorcycle frame space, the motorcycle frame space being oppositely laterally bounded by an oil filter manifold having an annular bearing surface, the oil filter manifold having removably attached thereto an oil filter, the oil filter having an oppositely lateral end, the apparatus comprising:

(a) a circular bushing fitted for passage of the oil filter therethrough, the bushing being further fitted for nesting receipt of the oil filter manifold's annular bearing surface, the bushing being, upon the nesting receipt by the bushing of the oil filter manifold's annular bearing surface, manually rotatable with respect to the annular bearing surface;

(b) an oil sluice having an oil catch end and an oil drain end, the oil sluice comprising a longitudinally and upwardly extending wall and an oppositely longitudinally and upwardly extending wall, the longitudinally and upwardly extending wall comprising a sluice leveling notch fitted for, upon manual rotation of the bushing with respect to the oil filter manifold's annular bearing surface, receipt of the motorcycle engine's at least first protrusion; and, (c) attaching means interconnecting the oil sluice and the bushing, the attaching means orienting the oil sluice so that, upon nesting receipt by the bushing of the oil filter manifold's annular bearing surface, the oil catch and oil drain ends of the oil sluice may respectively underlie the oil filter's oppositely lateral end and extend laterally from the motorcycle frame space; the bushing comprising plastic.

2. An apparatus for laterally conducting oil within a motorcycle frame space, the motorcycle frame space being longitudinally bounded by a motorcycle engine, the motorcycle engine having at least a first protrusion extending oppositely longitudinally into the motorcycle frame space, the motorcycle frame space being oppositely laterally bounded by an oil filter manifold having an annular bearing surface, the oil filter manifold having removably attached thereto an oil filter, the oil filter having an oppositely lateral end, the apparatus comprising:

(a) a bushing fitted for passage of the oil filter therethrough, the bushing being further fitted for nesting receipt of the oil filter manifold's annular bearing surface;

(b) an oil sluice having an oil catch end and an oil drain end; and, (c) attaching means interconnecting the oil sluice and the bushing, the attaching means orienting the oil sluice so that, upon nesting receipt by the bushing of the oil filter manifold's annular bearing surface, the oil catch and oil drain ends of the oil sluice may respectively underlie the oil filter's oppositely lateral end and extend laterally from the motorcycle frame space, the bushing having a lateral face, the lateral face having a lower end, the lower end of the bushing's lateral face having an upper end, and further comprising an oil backflow dam, the oil backflow dam comprising said upper end.

3. The apparatus for laterally conducting oil within a motorcycle frame space of claim 2 wherein the oil back flow dam is oppositely laterally set into the bushing.

4. A method for laterally conducting oil within a motorcycle frame space, the motorcycle frame space being longitudinally bounded by a motorcycle engine, the motorcycle engine having at least a first protrusion extending oppositely longitudinally into the motorcycle frame space, the motorcycle frame space being oppositely laterally bounded by an oil filter manifold having an annular bearing surface, the oil filter manifold having removably attached thereto an oil filter, the method comprising steps of:

(a) providing a bushing fitted for passage therethrough of the oil filter, the bushing being further fitted for nesting receipt of the oil filter manifold's annular bearing surface;

(b) providing an oil sluice having an oil drain end and an oil catch end, the oil catch end of the oil sluice being fixedly attached to the bushing;

(c) oppositely laterally extending the bushing into the motorcycle frame space;

(d) further oppositely laterally extending the bushing over the oil filter;

(e) nestingly receiving the oil filter manifold's annular bearing surface within the bushing;

(f) removing the oil filter from the oil filter manifold and flowing the oil from the oil filter manifold and from the oil filter;

(g) catching the oil upon the oil catch end of the oil sluice; and (h) laterally conducting the oil along the oil drain sluice toward the oil drain end; the oil sluice providing step further comprising provision of a sluice leveling notch extending oppositely longitudinally into the oil sluice, the sluice leveling notch being fitted for receipt of the motorcycle engine's at least first protrusion, and further comprising a step of manually rotating the bushing with respect to the oil filter manifold's annular bearing surface, and further comprising a step of receiving the motorcycle engine's at least first protrusion within the oil sluice's sluice leveling notch.

5. The method for laterally conducting oil within a motorcycle frame space of claim 4 further comprising a step of loosening the oil filter, said step being performed prior to the oppositely lateral extensions of the bushing.

6. The method for laterally conducting oil within a motorcycle frame space of claim 5 further comprising a step of placement of an oil catching basin or vessel beneath the oil drain end of the oil sluice.

* * * * *